US011408381B2

(12) United States Patent
Sinkemat et al.

(10) Patent No.: US 11,408,381 B2
(45) Date of Patent: Aug. 9, 2022

(54) PIPE COMPONENT

(71) Applicant: MANN+HUMMEL GmbH, Ludwigsburg (DE)

(72) Inventors: Stefan Sinkemat, Bad Harzburg (DE); Roland Welpe, Bad Harzburg (DE)

(73) Assignee: MANN+HUMMEL GmbH, Ludwigsburg (DE)

( * ) Notice: Subject to any disclaimer, the term of this patent is extended or adjusted under 35 U.S.C. 154(b) by 111 days.

(21) Appl. No.: 16/913,382

(22) Filed: Jun. 26, 2020

(65) Prior Publication Data

US 2021/0003104 A1 Jan. 7, 2021

(30) Foreign Application Priority Data

Jul. 1, 2019 (DE) ..... 10 2019 117 640.9

(51) Int. Cl.
*F02M 35/10* (2006.01)
*F02M 35/024* (2006.01)

(52) U.S. Cl.
CPC *F02M 35/10137* (2013.01); *F02M 35/10124* (2013.01); *F02M 35/024* (2013.01)

(58) Field of Classification Search
CPC ..... F02M 35/10137; F02M 35/10124; F02M 35/024; F16L 11/15; F16L 11/11; F16L 33/02
See application file for complete search history.

(56) References Cited

U.S. PATENT DOCUMENTS

| | | | | |
|---|---|---|---|---|
| 2,012,766 | A | 8/1935 | Meyer | |
| 6,056,018 | A | 5/2000 | Renaud | |
| 2002/0062873 | A1 | 5/2002 | Nakagawa et al. | |
| 2014/0261842 | A1* | 9/2014 | Kim | F16L 27/111 138/121 |
| 2015/0059906 | A1* | 3/2015 | Kim | F16L 11/04 138/121 |
| 2015/0361933 | A1 | 12/2015 | Kim et al. | |
| 2016/0177889 | A1 | 6/2016 | Matsubara et al. | |

FOREIGN PATENT DOCUMENTS

WO WO-2013075794 A1 * 5/2013 ..... B60S 1/50

* cited by examiner

*Primary Examiner* — Jacob M Amick
*Assistant Examiner* — Charles J Brauch

(57) ABSTRACT

The invention relates to a pipe component (10) having a pipe (11) between two end regions (14, 18), which comprises a fold package (30). The fold package (30) has at least one first fold region (32) having first folds (40) which extend around an outer circumference (24) of the pipe (11). The fold package (30) has at least one second fold region (34, 36) having second folds (42) which extend part of the way around the outer circumference (24).

11 Claims, 4 Drawing Sheets

PIPE COMPONENT

CROSS-REFERENCE TO RELATED APPLICATION

This application claims the benefit of German patent application No. 10 2019 117 640.9 having a filing date of 1 Jul. 2019, the entire contents of the aforesaid German patent application being incorporated herein by reference to the fullest extent permitted by the law.

TECHNICAL FIELD

The invention relates to a pipe component having a pipe between two end regions which comprises a fold package.

BACKGROUND

US 2016177889 A1 describes an intake air filter conduit of an intake manifold system. The air-conveying conduit comprises a bellows part and a flexible part having low rigidity. The flexible part is in a region between the bellows part and an end of the air-conveying conduit. The flexible part is enclosed in a part of the air-conveying conduit in the circumferential direction and has a curvature, such that a buckling load on the flexible part with respect to a compressive load in the axial direction is smaller than a buckling load in another region outside the flexible part with respect to the compressive load.

WO 99/22171 A1 describes a pipe component for an air-conveying system which has a bellows, the folds of which are partially flush with the surface of the pipe. As a result, the pipe component can be easily bent in the plane in which the folds are flush with the surface of the pipe.

SUMMARY OF THE INVENTION

An object of the invention is to provide a pipe component which has improved flexibility and high pressure-stability at the same time.

The aforementioned object is achieved by a pipe component comprising a pipe between two end regions, which comprises a fold package, the fold package having at least one first fold region which has first folds which extend around an outer circumference of the pipe, characterized in that the fold package has at least one second fold region having second folds which extend part of the way around the outer circumference.

Favorable embodiments and advantages of the invention can be found in the additional claims, the description and the drawings.

The invention relates to a pipe component comprising a pipe between two end regions, which comprises a fold package. The fold package has at least one first fold region which has first folds which extend around an outer circumference of the pipe. According to the invention, the fold package has at least one second fold region having second folds which extend part of the way around the outer circumference.

The pipe component according to the invention is particularly suitable for media-conveying systems, in particular unfiltered air duct systems, clean air duct systems and the like. The pipe component can be straight or curved.

Due to confined installation space conditions which require a high degree of flexibility in the conduit routing, and in order to compensate for installation tolerances but also to dampen vibrations, pipe components, such as straight cylindrical elements or curved pieces, are usually used with bellows. This allows a mechanical decoupling of two components that are connected via the pipe component. The folds of the bellows usually extend perpendicular to a central line of the pipe component, which line can in particular have a curved path, the central line extending in the longitudinal extension through the interior of the pipe component and maintaining the greatest possible distance from the outer walls of the component. In a cylindrical pipe component, the central line corresponds to the straight central axis of the pipe component. In a pipe component, the central line can be curved, straight or twisted into itself, such that the pipe component is curved, straight or twisted into itself, in particular in the non-installed, relaxed state, in which no external tension, pressure or torsion acts on the component.

In a cylindrical pipe component, the folds of a fold package usually extend rotationally symmetrically and form an angle of 90° with respect to the central axis of the cylindrical region.

In the pipe component according to the invention, at least in the second fold region, which can also be cylindrical, the second folds can extend at an angle that is different from 90°, i.e. obliquely, with respect to the central line. The first folds, in particular the folds of the first fold region, can be designed to be rotationally symmetrical, but can also have other individual, for example indented, designs. The second folds, which are only partially formed on the outer circumference of the pipe component, can, for example, only be formed on half the circumference or less. This is particularly advantageous in the case of pipe components which are short in length, since the available space can still be used for folds, and the pipe component can be very flexible despite the short length. As a result, a decoupling path of the pipe component is enlarged, and, in conduit routing using the same material, the pipe component is more flexible compared to a pipe component having folds arranged perpendicular to the central line.

With regard to flexibility, compressive rigidity, installation space requirements, choice of materials, media resistance, and operating temperature range, there are new design options for flexible pipe components in media-conveying systems that can be produced inexpensively.

Fold tips of the first and second folds can advantageously be formed equidistant from one another.

Thermoplastic materials are favorable as the material for the pipe component. Thermoplastic materials, thermoplastic elastomers and elastomers are particularly preferred. The pipe component can advantageously be produced by blow molding, in particular by extrusion blow molding.

Because the jacket of the pipe component consists of resilient material, a sealing contour can be provided at connection regions of the pipe component, for example for attaching pipe clamps or mating flanges. This can eliminate the need for separate seals for sealingly connecting the pipe component to a connector.

According to a favorable embodiment of the pipe component, the second fold region can adjoin the first fold region, in particular directly. In this way, for example, there can be a smooth transition from the first fold region having folds which extend all the way around the outer circumference of the pipe component, to the second fold region having second folds which are only partially circumferential. The length of the partially circumferential second folds on the outer circumference can also gradually decrease towards the end of the pipe component.

According to a favorable embodiment of the pipe component, the first and second folds can extend in parallel to one another in an initial state of the pipe, in particular in the relaxed state of the pipe. The relaxed state of the pipe component is the state in which the pipe component comes out of the manufacturing tool, and consequently has not yet subsequently been bent. In particular, the first and second folds are rotationally asymmetrical to a central line of the pipe, which line is enclosed by the relevant fold. The central line is in particular the central axis in the case of a cylindrical portion of the pipe. In this case, the folds of the first and second fold regions can extend in parallel over the entire length of the pipe component, and therefore each have different angles to the central line, which angles can deviate significantly from an angle of 90° in the case of a curved pipe component.

According to a favorable embodiment of the pipe component, first and/or second folds, in particular in the relaxed state of the pipe, can extend, at least in regions, at an angle of not equal to 90° with respect to a portion of the central line that the relevant fold encloses, in particular at an angle of between 5° and 85° with respect to a portion of the central line that the relevant fold encloses. The relaxed state of the pipe is the state of the pipe when the pipe component is not installed, when there is no tension, pressure or torsion acting on the component. The folds can advantageously extend obliquely at the angle to the central line, which angle can be freely adjusted during the production of the pipe component by means of an appropriate shaping of the manufacturing tool.

According to a favorable embodiment of the pipe component, second fold regions can adjoin the first fold region on both sides, in particular directly, which second fold regions have second folds that extend part of the way round the outer circumference. The pipe component can therefore have fold regions at both ends that have only partially circumferential second folds, such that the length of the pipe can be utilized for folds as favorably as possible in order to have the greatest possible flexibility of the pipe component.

According to a favorable embodiment of the pipe component, ends of the partially circumferential second folds can adjoin at least one connection region of the pipe. The ends of the partially circumferential second folds can thus utilize the installation space of the end regions of the pipe component to the connection regions as far as possible, in order to achieve the greatest possible flexibility of the pipe component.

According to a favorable embodiment of the pipe component, the second folds can surround the circumference of the pipe at least in regions by at least 180°. In this way, a high flexibility of the pipe component can be achieved. The length of the partially circumferential second folds on the outer circumference of the pipe component can also be gradated as favorably as possible for a maximum utilization of the available installation space of the end region.

According to a favorable embodiment of the pipe component, the ends of the second folds can rest on a surface which is parallel to a surface defined by an opening of the adjacent connection region. By means of such an embodiment, it can be ensured that the ends of the second folds maintain the same distance to the connection regions and thus provide the necessary space for connection components such as hose clamps or connection flanges.

According to a favorable embodiment of the pipe component, a cross section of a fold tip can be designed as an arcuate section or as a trapezoidal section. As a result of choosing a suitable cross section for the fold tips, a utilization of installation space that is as favorable as possible can also be achieved in the case of curved bellows. In this way, the largest possible free inner region of the pipe component can be provided in the fold region for a favorable flow of the conveyed fluid. Folds in the shape of trapezoidal sections often also allow a greater flexibility of the pipe component than folds in the shape of arcuate sections.

According to a favorable embodiment of the pipe component, the pipe can be produced by blow molding, in particular by extrusion blow molding. Such manufacturing processes are favorable for use for plastics components and ensure a freest possible component design. Extrusion blow molding processes have the advantage that no internal molds are required during the production, which makes the production process cheaper.

According to a favorable embodiment of the pipe component, the pipe component can be made from a resilient thermoplastic. For example, materials such as polyamides (PA), or also ethylene propylene diene (monomer) rubber (EPDM), are inexpensive to use.

According to a favorable embodiment of the pipe component, a cross section of the fold package can be circular or rectangular at least in regions. Circular cross sections of pipes are frequently used designs for air-conveying systems of intake manifold systems in internal combustion engines. However, the pipe component according to the invention can also be used on pipes having rectangular cross sections.

BRIEF DESCRIPTION OF THE DRAWINGS

Further advantages can be found in the following description of the drawings. Embodiments of the invention are shown in the drawings. The drawings, the description and the claims contain numerous features in combination. A person skilled in the art will expediently also consider the features individually and combine them into other appropriate combinations.

In the drawings, by way of example.

EMBODIMENTS OF THE INVENTION

Figure 1:
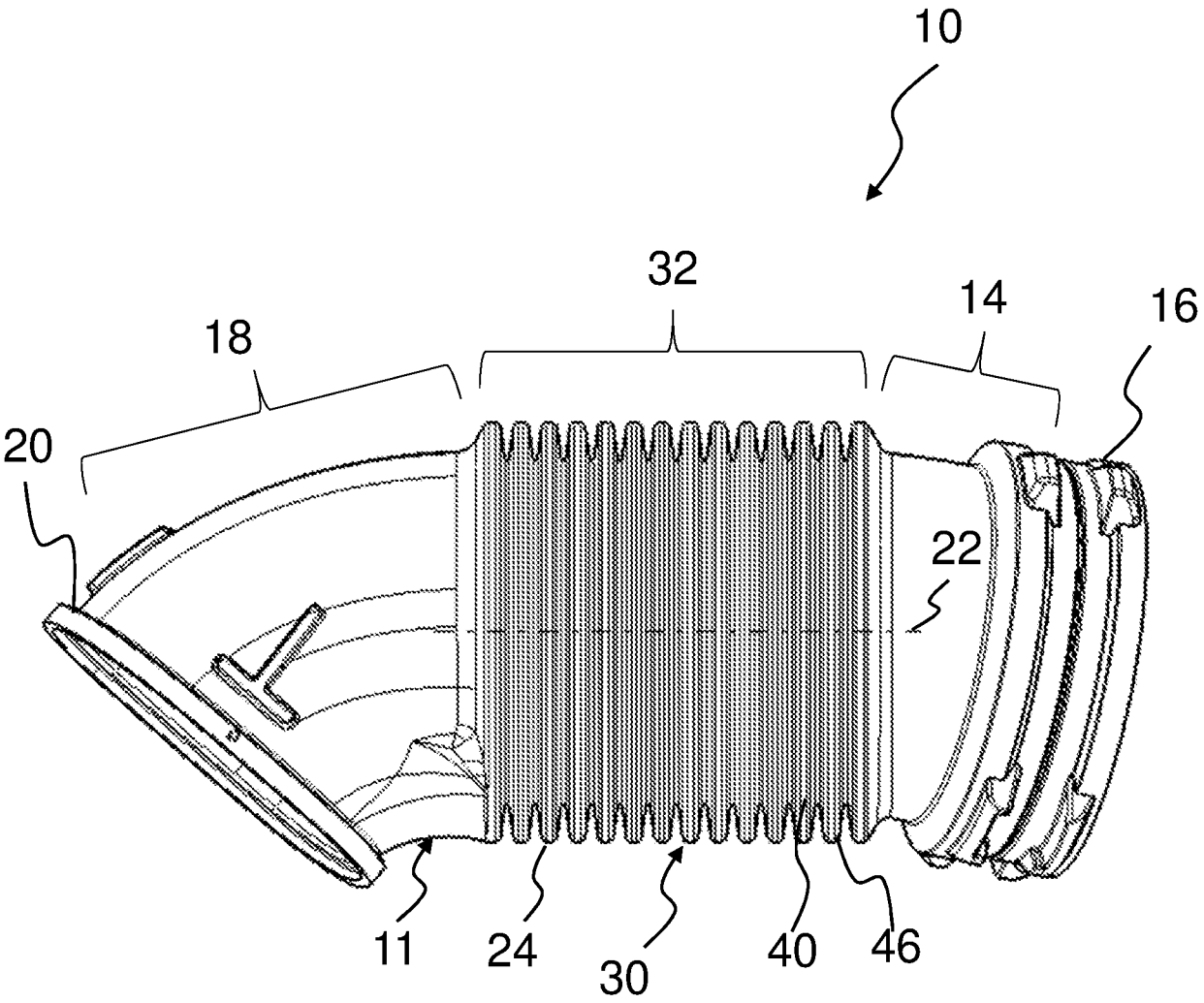
FIG. 1 is an isometric view of a pipe component according to the prior art.

In the drawings, components which are the same or similar are denoted using the same reference signs. The figures only show examples and are not to be understood as limiting.

FIG. 1, as a comparison, is an isometric view of a pipe component 10 according to the prior art. The pipe component 10 is, for example, an air-conveying connection element of an intake manifold system of an internal combustion engine, which connects an air filter to the internal combustion engine. The pipe component 10 which is designed as bellows comprises a fold package 30 in order to comply with narrow space requirements and installation tolerances.

Due to confined installation space conditions which require a high degree of flexibility in the conduit routing, and in order to compensate for installation tolerances but also to dampen vibrations, pipe components 10, such as straight cylindrical elements or curved pieces, are usually used with bellows. This allows a mechanical decoupling of two components. The folds 40 of the bellows usually extend perpendicular to a central line 22 of the pipe component 10, which line defines a central line which extends in the longitudinal extension through the interior of the pipe component 10 and maintains the greatest possible distance from the outer walls of the component 10. In a cylindrical pipe component 10, the central line 22 corresponds to the central axis of the pipe component 10. In a curved pipe component 10, the central line 22 can be curved, straight or twisted into itself.

In a cylindrical pipe component 10, the folds 40 of a fold region 32 usually extend rotationally symmetrically and form an angle of 90° with respect to the central axis 22 of the cylindrical region.

The pipe component 10 in FIG. 1 is shown in a relaxed initial state, as it is, for example, when it comes out of a manufacturing tool, and is shown having not yet been bent further, as may be necessary, for example, for installation in the engine installation space of a motor vehicle.

The pipe component 10 according to the prior art in FIG. 1 comprises a pipe 11 between two end regions 14, 18 which has the fold package 30. The fold package 30 has a single first fold region 32 having first folds 40 which extend around an outer circumference 24 of the pipe 11. The first fold region 32 is arranged on a cylindrical portion of the pipe 11. The folds 40 are rotationally symmetrical and extend perpendicular to the central line 22 of the pipe portion in the first fold region 32. The central line 22 is only shown in the cylindrical part of the pipe 11 in FIG. 1, as the central axis, since the fold package 30 having the fold region 32 is only formed in this part.

Cross sections of the fold tips 46 are circular in the example in FIG. 1.

The ends of the end regions 14, 18 that face away from the first fold region 32 open into connection regions 16, 20, it being possible for the connection region 16 to be connected to the air filter, and for the connection region 20 to be connected to the internal combustion engine, for example.

Figure 2:
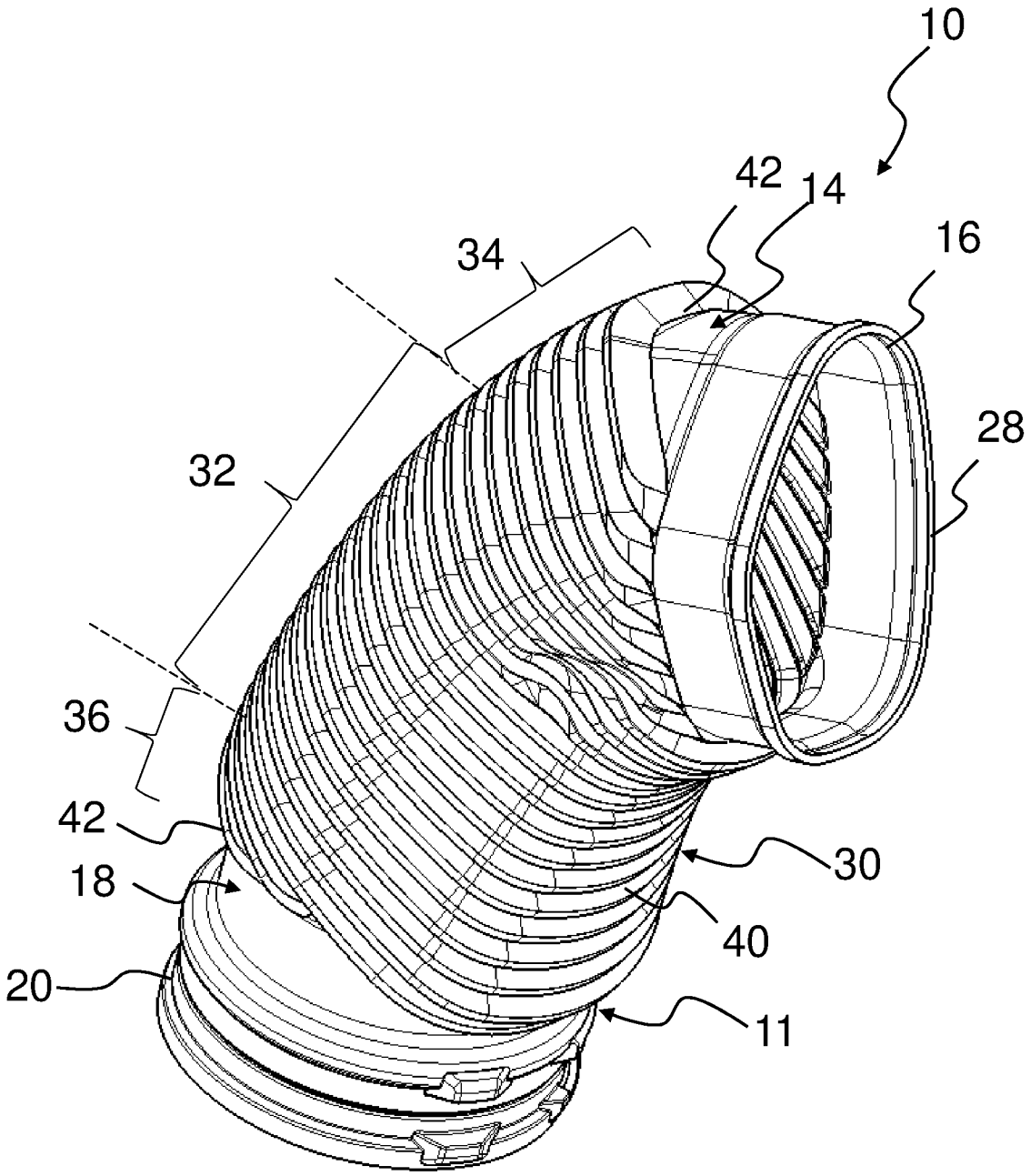
FIG. 2 is an isometric view of a pipe component according to an embodiment of the invention.
Figure 3:
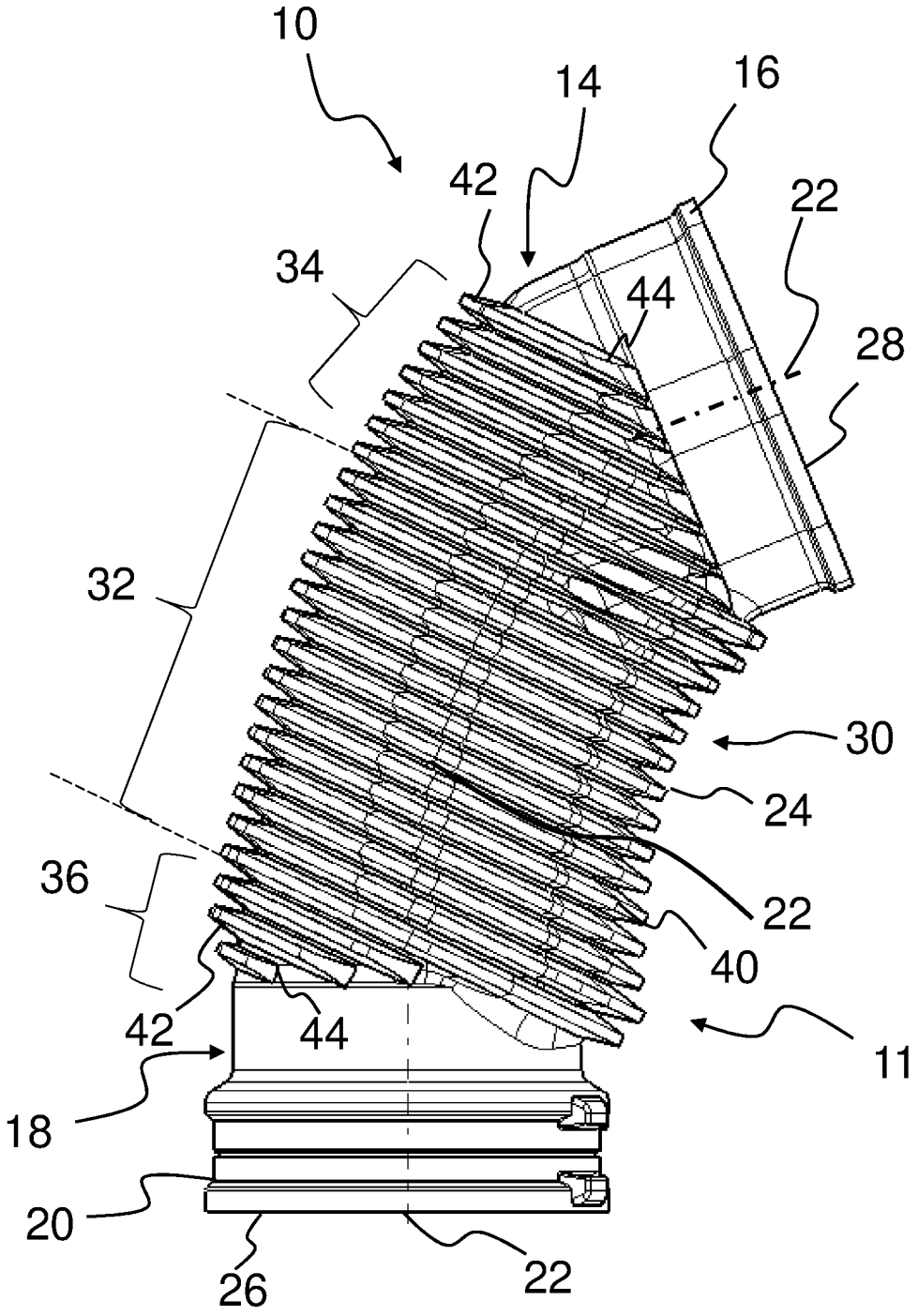
FIG. 3 is a side view of the pipe component according to FIG. 2.
Figure 4:
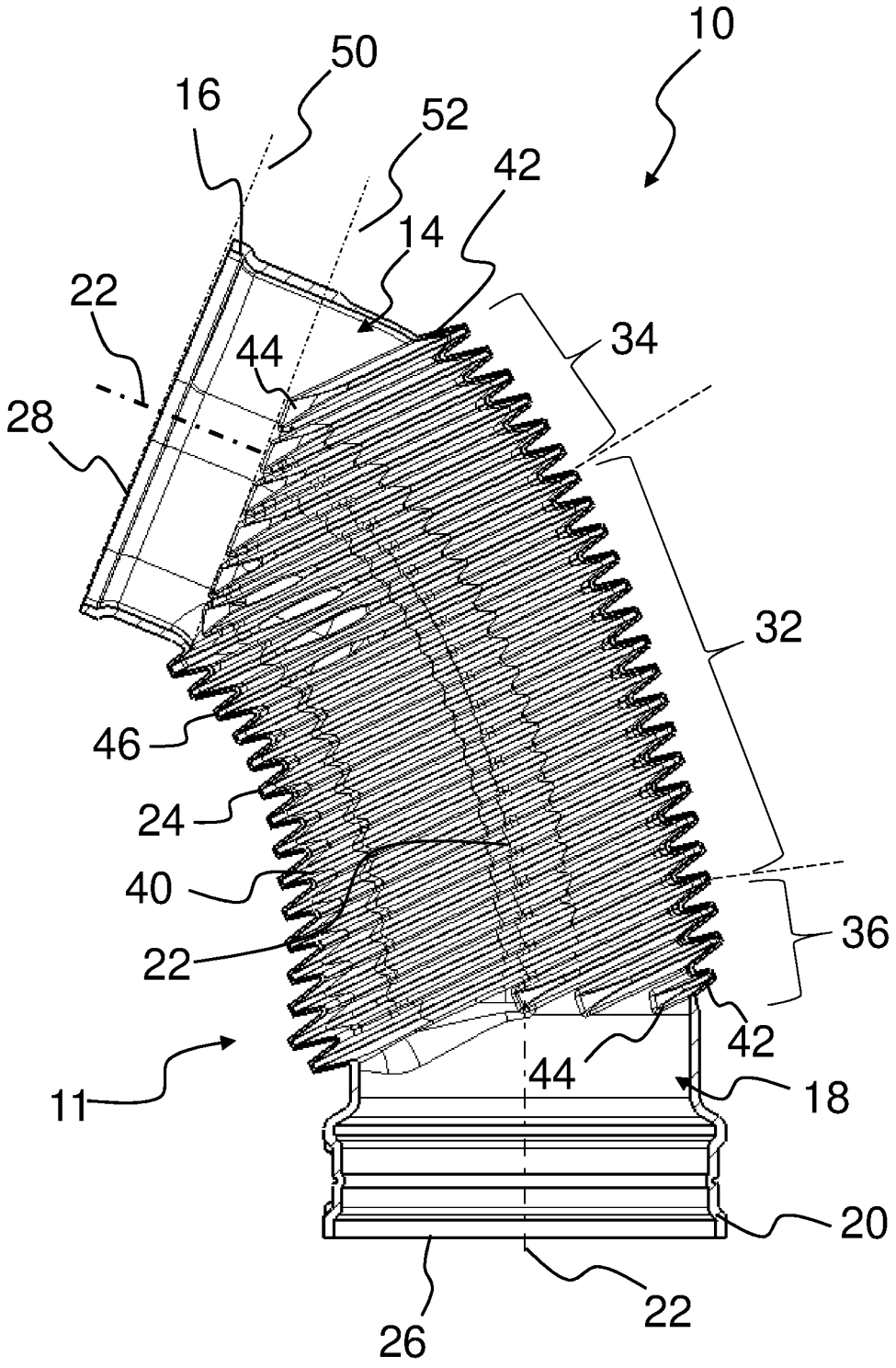
FIG. 4 is a longitudinal section of the pipe component according to FIG. 2.

FIG. 2 is an isometric view of a pipe component 10 according to an embodiment of the invention, while FIG. 3 is a side view of the pipe component 10 and FIG. 4 is a longitudinal section of the pipe component 10.

The pipe component 10 is shown in a relaxed initial state, as it is, for example, when it comes out of a manufacturing tool, and is shown having not yet been bent further, as may be necessary, for example, for installation in the engine installation space of a motor vehicle.

In the embodiment of the invention shown in FIGS. 2 to 4, the fold package 30 has a first fold region 32 which is arranged between second fold regions 34, 36 on both sides. The first fold region 32 has first folds 40 which extend all the way around the pipe 11 on the outer circumference 24. The second fold region 34, 36 has second folds 42, which extend only part of the way round around the outer circumference 24. In this case, the second fold regions 34, 36 directly adjoin the first fold region 32 on both sides, in order to accommodate the largest possible number of second folds 42 in the available installation space of the end regions 14, 18 of the pipe 11.

A central line 22 is also strongly curved due to the curved longitudinal extension of the pipe 11.

The first folds 40 of the first fold region 32 and the second folds 42 extend in parallel with one another. In particular, the first and second folds 40, 42 are rotationally asymmetrical, i.e. they are not rotationally symmetrical to a central line 22 which the relevant fold 40, 42 encloses.

The first folds 40 and the second folds 42, in particular in the relaxed state of the pipe 11, extend, at least in regions, at an angle of not equal to 90° with respect to a portion of the central line 22 which the relevant fold 40, 42 encloses. In particular, the angle can extend at substantially less 90° with respect to a portion of the central line 22 which the relevant fold 40, 42 encloses, extend. Since the first and second folds 40, 42 extend in parallel to one another in the initial state of the pipe 11, in particular in the relaxed state of the pipe 11, said folds extend at very different angles, depending on the position of the fold 40, 42 with respect to the central line 22.

The second folds 42 surround the circumference 24 of the pipe 11 at the transition to the first fold region 32 at least in regions, by at least 180° around the central line 22. As the distance from the first fold region 32 increases, the region around which the partially circumferential second folds 42 surround the circumference 24 gradually decreases and can be significantly smaller than 180°. As can be seen in particular in the longitudinal section in FIG. 4, the ends 44 of the second folds 42 rest on a surface 52 which is parallel to a surface 50 defined by an opening 28 of the adjacent connection region 16.

In the embodiment shown in FIGS. 2 to 4, the ends 44 of the partially circumferential second folds 42 are shown spaced apart from the connection regions 16, 20. In an alternative embodiment, however, the folds can also directly adjoin the connection regions 16, 20 of the pipe 11, in order to accommodate a maximum number of folds 42 in the available installation space.

Due to the great flexibility resulting from the second fold regions 34, 36, the pipe component 10 in the shown embodiment according to the invention can be bent in a very favorable manner when installed in an intake manifold system between an air filter and an internal combustion engine, in order to meet the restricted installation space requirements of an engine compartment of a motor vehicle. At the same time, the pipe component can be made of material which is sufficiently solid to also meet the corresponding pressure requirements. In this case, the flexibility is provided by the large number of first and second folds 40, 42, which can be accommodated on the same length of a pipe 11, by comparison with the prior art. The pipe component 10 can therefore favorably assume various bends, and can also advantageously be subjected to shear stress.

As shown in the embodiment in FIGS. 2 to 4, the cross section of the fold package 30 can be circular at least in regions. Alternatively, however, rectangular cross sections are also possible. The pipe 11 can advantageously be produced, for example, by blow molding, in particular by extrusion blow molding, and consist of a resilient thermoplastic, such as, for example, PA or EPDM.

The cross section of a fold tip 46 can be designed, for example, as an arcuate section, as shown in the prior art in FIG. 1, or as a trapezoidal section, as can be seen in the embodiment in FIG. 4. Folds in the shape of a trapezoidal section often have a slightly higher flexibility than folds in the shape of an arcuate section. The use of installation space is also more favorable using folds in the shape of a trapezoidal section.

What is claimed is:

1. A pipe component comprising;

a pipe extending from a first end region to a second end region of the pipe, the pipe comprising:

a fold package comprising at least one first fold region which has a plurality of first folds which extend fully around an outer circumference of the pipe;

wherein the fold package includes at least one second fold region having a plurality of second folds which extend circumferentially only partially around the outer circumference of the pipe;

wherein the first end region has a first pipe connection having a first pipe opening where the pipe opens to an outside environment;

wherein the second end region has a second pipe connection having a second pipe opening where the pipe opens to an outside environment;

wherein the pipe has a central line extending along a center line of an interior of the pipe from the first pipe opening to the second pipe opening, wherein the central line is curved or bent such that the pipe is curved or bent along the central line from the first end region to the second end region;

wherein at least some of the first or second folds have fold tips that are rotationally asymmetrical to the central line, such that the fold tips extend at an oblique angle relative to the central line such that the fold tips equidistantly spaced apart on the outer circumference of the curved or bent pipe.

2. The pipe component according to claim 1, wherein the second fold region directly adjoins the first fold region.

3. The pipe component according to claim 1, wherein in the initial relaxed state of the pipe, the plurality of first and second folds extend, at least in regions, at an angle of between 5 degrees and 85 degrees with respect to a portion of the central line that the relevant fold encloses.

4. The pipe component according to claim 1, wherein the second fold regions directly adjoin the first fold region on opposite axial ends of the first fold region, wherein the second fold regions have individual second folds of the plurality of second folds which extend part of the way around the outer circumference of the pipe.

5. The pipe component according to claim 1, wherein the at least one second fold region has a first axial end that adjoins the first fold region;

wherein the at least one second fold region has an opposite second axial end;

the at least one second fold region has an end fold which arranged as a final fold of the plurality of second folds arranged at the second axial end of the at least one second fold region.

6. The pipe component according to claim 1, wherein at least some of the plurality of second folds only partially surround the outer circumference of the pipe by an angle of at least 180 degrees.

7. The pipe component according to claim 4, wherein the end folds of the at least one second fold region rest on a circumferential outer surface of the pipe at the first end region or the second end region, which is parallel to an opening surface defined by an outer circumference of a nearest one of the first pipe opening or the second pipe opening.

8. The pipe component according to claim 4, wherein the plurality of first folds or the plurality of second folds having radially outer fold tips which have an arcuate section or a trapezoidal section.

9. The pipe component according to claim 4, wherein the pipe component is a one piece extrusion blow molded pipe.

10. The pipe component according to claim 4, wherein the pipe component is made of a resilient thermoplastic.

11. The pipe component according to claim 1, wherein a cross section of the folds in the fold package is circular or rectangular, at least in regions.

* * * * *